US010030525B2

(12) United States Patent
Bergholz

(10) Patent No.: US 10,030,525 B2
(45) Date of Patent: Jul. 24, 2018

(54) TURBINE ENGINE COMPONENT WITH DIFFUSER HOLES

(71) Applicant: General Electric Company, Schenectady, NY (US)

(72) Inventor: Robert Frederick Bergholz, West Chester, OH (US)

(73) Assignee: General Electric Company, Schenectady, NY (US)

( * ) Notice: Subject to any disclaimer, the term of this patent is extended or adjusted under 35 U.S.C. 154(b) by 396 days.

(21) Appl. No.: 14/661,975

(22) Filed: Mar. 18, 2015

(65) Prior Publication Data

US 2016/0273364 A1 Sep. 22, 2016

(51) Int. Cl.

| | |
|---|---|
| ***F01D 5/18*** | (2006.01) |
| ***F01D 9/06*** | (2006.01) |
| ***F23R 3/00*** | (2006.01) |

(52) U.S. Cl.

CPC ..... *F01D 5/186* (2013.01); *F01D 9/065* (2013.01); *F23R 3/002* (2013.01); *F05D 2240/11* (2013.01); *F05D 2240/81* (2013.01); *F05D 2250/21* (2013.01); *F05D 2250/23* (2013.01); *F05D 2260/202* (2013.01); *F23R 2900/03042* (2013.01)

(58) Field of Classification Search

CPC ..... F01D 5/186; F01D 5/187; F01D 9/065; F05D 2260/202; F05D 2240/11; F05D 2240/81; F05D 2250/21; F05D 2250/23; F23R 3/002; F23R 2900/03042

See application file for complete search history.

(56) References Cited

U.S. PATENT DOCUMENTS

| | | | | |
|---|---|---|---|---|
| 6,979,176 | B2 * | 12/2005 | Nakamata | F01D 5/186 416/97 R |
| 7,246,992 | B2 | 7/2007 | Lee | |
| 7,563,073 | B1 | 7/2009 | Liang | |
| 7,887,294 | B1 | 2/2011 | Liang | |
| 8,231,330 | B1 * | 7/2012 | Liang | F01D 5/186 415/115 |
| 8,245,519 | B1 | 8/2012 | Liang | |
| 8,522,558 | B1 * | 9/2013 | Xu | F01D 5/186 415/115 |
| 8,683,813 | B2 * | 4/2014 | Xu | F01D 5/186 415/115 |
| 8,689,568 | B2 * | 4/2014 | Kohli | F01D 5/186 415/116 |
| 2008/0003096 | A1 * | 1/2008 | Kohli | F01D 5/186 415/115 |

(Continued)

*Primary Examiner* — Woody Lee, Jr.
*Assistant Examiner* — Sang K Kim
(74) *Attorney, Agent, or Firm* — General Electric Company; William Andes

(57) ABSTRACT

A turbine component includes a component wall with inner and outer surfaces wherein a diffuser hole passes through the component wall between the inner surface and the outer surface. The diffuser hole has a hole axis and includes: a metering section extending from an inlet at the inner surface to a junction plane between the inner and outer surfaces; and a diffuser section extending from the junction plane to an outlet at the outer surface, and increasing in flow area from the junction plane to the outlet, the diffuser section having an upstream portion defining a first area ratio and a downstream portion defining a second area ratio different from the first area ratio.

12 Claims, 6 Drawing Sheets

(56) References Cited

U.S. PATENT DOCUMENTS

| | | | | |
|---|---|---|---|---|
| 2013/0175015 | A1* | 7/2013 | Tanaka | F01D 5/186<br>165/168 |
| 2013/0206739 | A1* | 8/2013 | Reed | F01D 25/12<br>219/121.71 |
| 2013/0209234 | A1* | 8/2013 | Xu | F23R 3/06<br>415/116 |
| 2013/0302179 | A1* | 11/2013 | Bergholz, Jr. | F01D 5/186<br>416/97 R |
| 2015/0159871 | A1* | 6/2015 | Pearson | F23R 3/06<br>60/754 |
| 2015/0377033 | A1* | 12/2015 | Xu | F01D 11/08<br>60/755 |

* cited by examiner

TURBINE ENGINE COMPONENT WITH DIFFUSER HOLES

BACKGROUND OF THE INVENTION

This invention relates generally to gas turbine engines and more particularly to cooling hole structures in components of such engines.

In a gas turbine engine, air is compressed in a compressor, mixed with fuel and ignited in a combustor for generating hot combustion gases which flow downstream through one or more stages of turbine nozzles and blades. The nozzles include stationary vanes followed in turn by a corresponding row of turbine rotor blades attached to the perimeter of a rotating disk. The vanes and blades have correspondingly configured airfoils which are hollow and include various cooling circuits and features which receive a portion of air bled from the compressor for providing cooling against the heat from the combustion gases.

The turbine vane and blade cooling art discloses various configurations for enhancing cooling and reducing the required amount of cooling air in order to increase the overall efficiency of the engine while obtaining a suitable useful life for the vanes and blades. For example, typical vane and blade airfoils in the high pressure turbine section of the engine include cooling holes that extend through the pressure side, or suction side, or both, for discharging a film of cooling air along the outer surface of the airfoil to effect film cooling in a conventional manner.

A typical film cooling hole is in the form of a cylindrical aperture inclined axially through one of the airfoil sides, such as the pressure side, for discharging the film air in the aft direction. The cooling holes are typically provided in a radial or spanwise row of holes at a specific pitch spacing. In this way, the cooling holes discharge a cooling film that forms an air blanket for protecting the outer surface, otherwise known as "lands" of the airfoil from hot combustion gases during operation.

In order to improve the performance of cooling holes, it is also known to modify their shape to effect cooling flow diffusion. The diffusion reduces the discharge velocity and increases the static pressure of the airflow. Diffusion cooling holes are known in various configurations for improving film cooling effectiveness with suitable blowing ratios and backflow margin. A typical diffusion film cooling hole may be conical from inlet to outlet with a suitable increasing area ratio for effecting diffusion without undesirable flow separation. Diffusion occurs in three axes, i.e. along the length of the hole and in two in-plane perpendicular orthogonal axes. Other types of diffusion cooling holes are also found in the prior art including various rectangular-shaped holes, and holes having one or more squared sides in order to provide varying performance characteristics. Like conical diffusion holes, the rectangular diffusion holes also effect diffusion in three dimensions as the cooling air flows therethrough and is discharged along the outer surface of the airfoil.

However, prior art diffusion holes often behave like over-expanded nozzles, experiencing choking and flow shocks at operating pressure ratios. This can make their flow behavior unpredictable and reduce film cooling efficiency Accordingly, there remains a need to further improve film cooling by providing cooling holes that promote attached film flow diffusion and downstream spreading.

BRIEF DESCRIPTION OF THE INVENTION

This need is addressed by the present invention, which provides shaped-contoured diffuser film holes having multiple diffusion angles, relatively large footprint coverage, and optional internal plug or pedestal features effective to improve attached film flow diffusion and downstream spreading.

According to one aspect of the invention, a turbine component has a component wall with inner and outer surfaces wherein a diffuser hole posses through the component wall between the inner surface and the outer surface. The diffuser hole has a hole axis and includes: a metering section extending from an inlet at the inner surface to a junction plane between the inner and outer surfaces; and a diffuser section extending from the junction plane to an outlet at the outer surface, and increasing in flow area from the junction plane to the outlet, the diffuser section having an upstream portion defining a first area ratio and a downstream portion defining a second area ratio different from the first area ratio.

According to another aspect of the invention, a turbine component has a component wall with inner and outer surfaces wherein a diffuser hole passes through the component wall between the inner surface and the outer surface. The diffuser hole has a hole axis and includes: a metering section extending from an inlet at the inner surface to a junction plane between the inner and outer surfaces; and a diffuser section extending from the junction plane to an outlet at the outer surface, and increasing in flow area from the junction plane to the outlet, the diffuser section having an upstream portion defining a first area ratio and a downstream portion defining a second area ratio different from the first area ratio; wherein the diffuser section is defined by an outer wall adjacent the outer surface, an inner wall adjacent the inner surface, and a pair of spaced-apart side walls extending between the inner and outer walls; the diffuser section includes a diffuser pedestal extending radially outwardly from the inner wall, so as to effectively divide the aft portion of the diffuser section into two separate legs.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
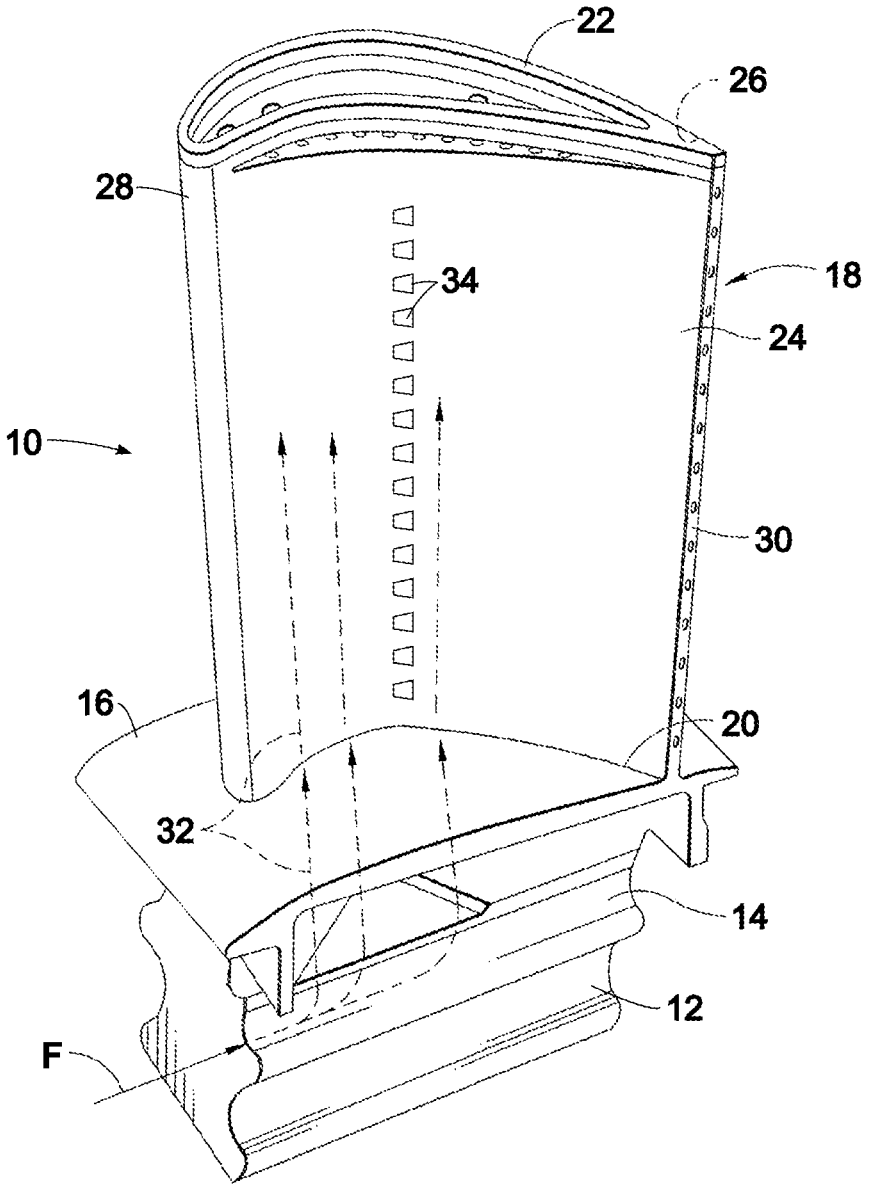
FIG. 1 is a perspective view of a gas turbine engine rotor blade including diffuser holes constructed in accordance with an embodiment of the present invention.

Referring to the drawings wherein identical reference numerals denote the same elements throughout the various views, FIG. 1 illustrates an exemplary turbine rotor blade 10. The turbine blade 10 includes a conventional dovetail 12 for radially retaining the blade 10 to the disk as it rotates during operation. A blade shank 14 extends radially upwardly from the dovetail 12 and terminates in a platform 16 that projects laterally outwardly from and surrounds the shank 14. The platform 16 defines a portion of the combustion gases past the turbine blade 10. A hollow airfoil 18 extends radially outwardly from a root 20 at the platform 16 to a tip 22. The airfoil 18 has a concave pressure sidewall 24 and a convex suction sidewall 26 joined together at a leading edge 28 and at a trailing edge 30.

The turbine blade 10 includes an internal cooling circuit 32 for channeling cooling fluid "F" through the airfoil 18 for providing cooling during operation. The cooling circuit 32 may take any conventional form including various channels extending through the airfoil 18, such as along the leading edge 28, along the trailing edge 30 and along a mid-chord area in the form of a suitable serpentine fluid path. In the airfoil 18 shown in FIG. 1, the cooling fluid "F" may be channeled from the engine compressor and through suitable apertures between the blade dovetail 12 and its respective axial dovetail slot in the disk in any conventional manner.

The airfoil 18 is shown as incorporating a plurality of leading edge cooling holes 34 spaced-apart in a radially-extending row along the leading edge 28 for discharging the cooling fluid "F" from the cooling circuit 32 inside the airfoil 18 along its outer surface to provide a cooling film of fluid onto the surface of the airfoil 18. These cooling holes 34 incorporate an increasing-area portion which is effective to act as a diffuser, and may thus be referred to as "diffuser film cooling holes" or simply "diffuser holes." The present invention relates to novel designs for the diffuser holes. It is noted that the principles of the present invention are applicable to any turbine engine structure that requires film cooling in operation, such as rotating blades, stationary vanes, turbine blade shrouds, combustor liners, and the like. These structures are generally referred to herein as "turbine components".

Figure 4:
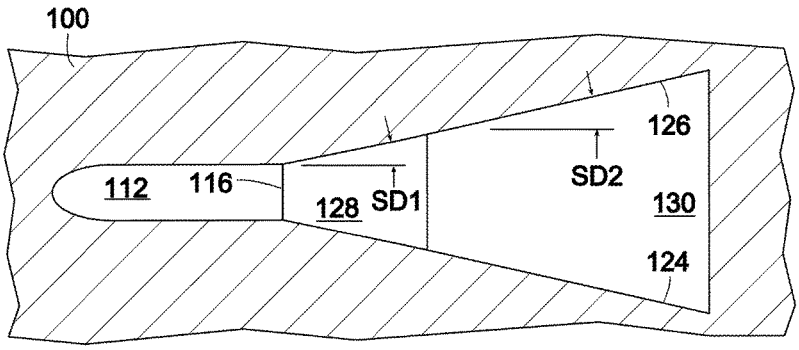
FIG. 4 is a cross-sectional view taken along lines 4-4 of FIG. 3.
Figure 3:
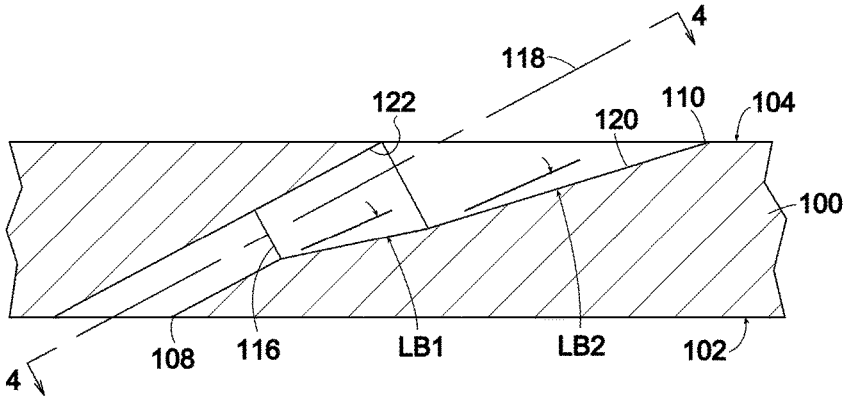
FIG. 3 is a cross-sectional view taken along lines 3-3 of FIG. 2.
Figure 2:
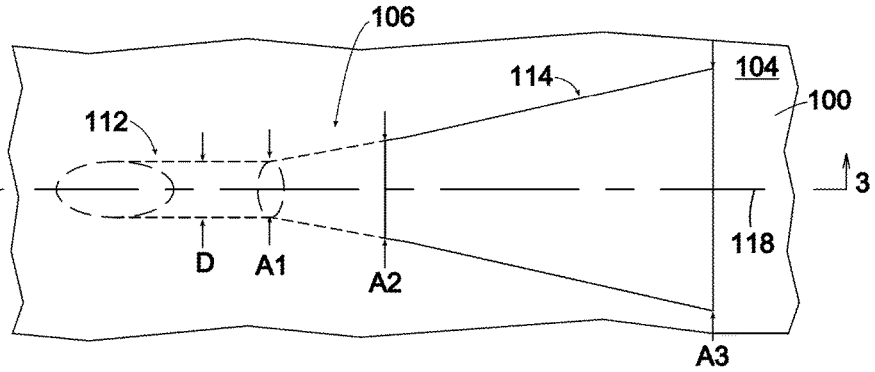
FIG. 2 is a top plan view of a portion of a component wall incorporating a diffuser hole constructed in accordance with an aspect of the present invention.

FIGS. 2, 3, and 4 illustrate a portion of a component wall 100 having an inner surface 102 and an outer surface 104. The component wall 100 is generically representative of a wall of the airfoil 18, or any other component that includes diffuser holes. A diffuser hole 106 is formed in the component wall 100. Only one representative diffuser hole 106 is shown, with the understanding that such holes are typically arrayed in rows along a component. The diffuser hole 106 extends from an inlet 108 at the inner surface 102 of the component wall 100 to an outlet 110 at the outer surface 104 of the component wall 100. In operation, fluid flows from the inlet 108 to the outlet 110, and the terms "upstream" and "downstream" are used with reference to this flow. The diffuser hole 106 includes a metering section 112 at its upstream end, and a diffuser section 114 at its downstream end. The metering section 112 may be generally cylindrical (as illustrated) or could be some other cross-sectional shape. The flow area is constant over the length of the metering section 112. The two sections 112 and 114 meet at a common junction plane 116. A hole axis 118 extends coaxially to the metering section 112.

The metering section 112 has an area (represented by diameter "D" in the case of a cylindrical shape) which is selected, in accordance with known practices, to provide a desired mass flow rate of cooling air, given specific pressure and velocity conditions upstream and downstream of the diffuser hole 106.

The diffuser section 114 is tapered, increasing in flow area from the metering section 112 to the outlet 110. More specifically, a flow area "A1" at the junction plane 116 is smaller than a flow area "A3" at the outlet 110. Laterally, the diffuser section 114 is bounded by an inner wall 120, an outer wall 122, and a pair of side walls 124, 126. The four walls 120, 122, 124, and 126 merge together into one continuous peripheral wall at the junction plane 116.

The outer wall 122 may extend generally parallel to the metering section 112. The outer wall 122 may also be considered to define a "hood" of the diffuser section 114. The inner wall 120 diverges away from the hole axis 118 at angle called a "layback angle," measured in a plane perpendicular to the outer surface 104 of the component wall 100. The side walls 124, 126 diverge away from the hole axis 118 at a side diffusion angle, measured in a plane parallel to the outer surface 104 of the component wall 100.

The diffuser section 114 has an upstream portion 128 adjacent the metering section 112, and a downstream portion 130 adjacent the outlet 110. Both the upstream portion 128 and the downstream portion 130 are tapered, increasing in flow area from the metering section 112 to the outlet 110. More specifically, the flow area "A2" at the intersection of the upstream and downstream portions 128, 130 is larger than a flow area "A1" at the junction plane 116, and the flow area "A3" at the outlet 110 is larger than then flow area "A2".

The ratio A2/A1 of the upstream portion 128 defines a first area ratio. The ratio A3/A2 of the downstream portion 130 defines a second area ratio. The first area ratio is selected explicitly to control flow expansion and minimize flow separation. The second area ratio is selected explicitly to effected a desired "covered area", or area of the outer surface 104 that is covered by the discharged air film. The size of the covered area is determined by the lateral spread of the air film in a lateral direction (that is, a direction in the plane of the outer surface 104 and perpendicular to the hole axis 118).

The diffuser section 114 thus includes two different area ratios. The boundaries of each portion 128, 130, may be formed by walls which are planar, curved (e.g. concave or convex), or some combination thereof. In the illustrated example the upstream portion 128 has a first layback angle LB1 and a first side diffusion angle SD1, and the downstream portion 130 has a second layback angle LB2 different from the first layback angle LB1, and a second side diffusion angle SD2 different from the first side diffusion angle SD1. The transition between the two portions 128, 130 may be continuous or discrete.

Figure 5:
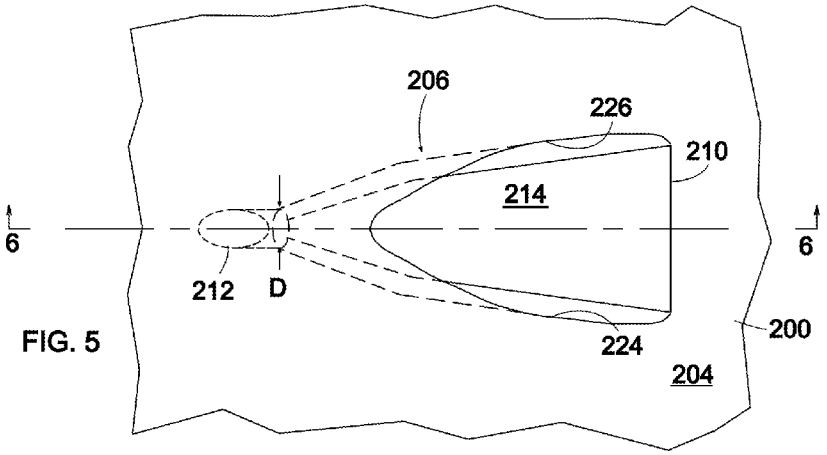
FIG. 5 is a top plan view of a portion of a component wall incorporating an alternative diffuser hole constructed in accordance with an aspect of the present invention.
Figure 6:
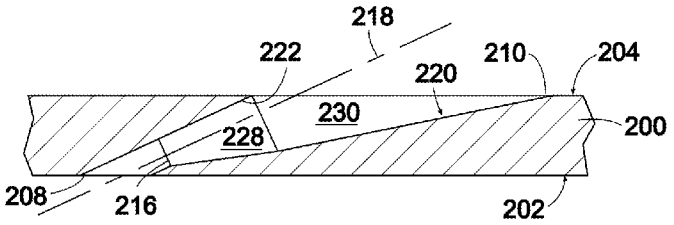
FIG. 6 is a cross-sectional view taken along lines 6-6 of FIG. 5.
Figure 7:
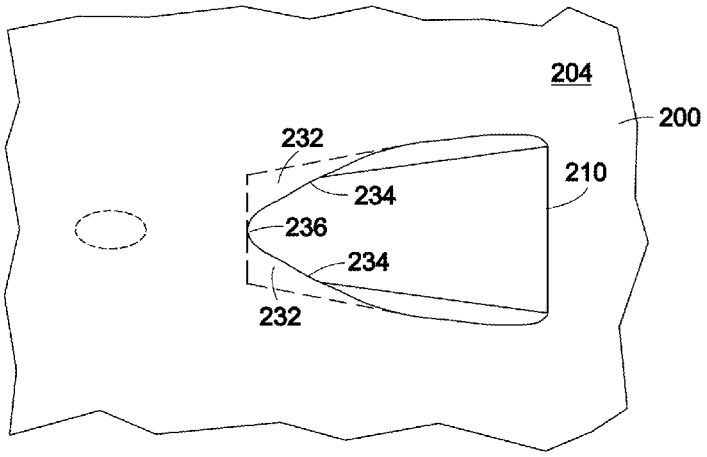
FIG. 7 is an alternative plan view of the component wall of FIG. 5.

FIGS. 5-7 illustrate a portion of a component wall 200 having an alternative diffuser hole 206 formed therein. The diffuser hole 206 is similar in construction to the diffuser hole 106 described above. Elements of the diffuser hole 206 which are not separately described may be considered to be identical to corresponding elements of the diffuser hole 106. The diffuser hole 206 extends from an inlet 208 at the inner surface 202 of the component wall 200 to an outlet 210 at the outer surface 204 of the component wall 200. The diffuser hole 206 includes a metering section 212 at its upstream end (cylindrical in this example), and a diffuser section 214 at its downstream end. The two sections 212 and 214 meet at a common junction plane 216. A hole axis 218 extends coaxially to the metering section 212.

The metering section 212 has an area (represented by diameter "D" in the case of a cylindrical shape) which is selected, in accordance with known practices, to provide a desired mass flow rate of cooling air, given specific pressure and velocity conditions upstream and downstream of the diffuser hole 206.

The diffuser section 214 includes upstream and downstream portions 228 and 230 having different area ratios, as described above. Laterally, the diffuser section 214 is bounded by an inner wall 220, an outer wall 222, and a pair of side walls 224, 226. The four walls 220, 222, 224, and 226 merge together into one continuous peripheral wall at the junction plane 216.

The diffuser section 214 includes a pair of laterally-symmetrical wings 232 which are effectively extensions of the outer wall 222. Each wing 232 interconnects the outer wall 222 and one of the side walls 224, 226. Each wing 232 has an aft edge 234 extending at an acute angle to the hole axis 218. Collectively, the aft edges 234 of the two wings 232 form a "V"-shape with a concave curve 236 at its apex. FIG. 7 shows only the exterior visible portions of the diffuser hole 206, with the extent of the wings 232 (relative to the hooded area of a prior art diffuser hole) shown by dashed lines.

The wings 232 increase the effective hooded length of the diffuser hole 206, defined as the length from the junction plane 216 to the aft end of the outer wall 222, measured parallel to the hole axis 218. The shape and dimensions of the wings 232 can be varied to suit a particular application.

Figure 8:
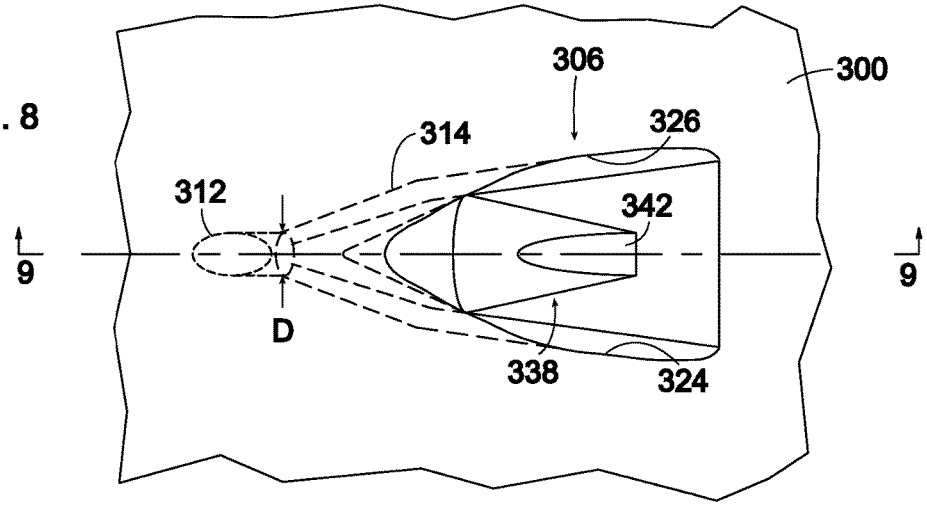
FIG. 8 is a top plan view of a portion of a component wall incorporating an another alternative diffuser hole constructed in accordance with an aspect of the present invention.
Figure 9:
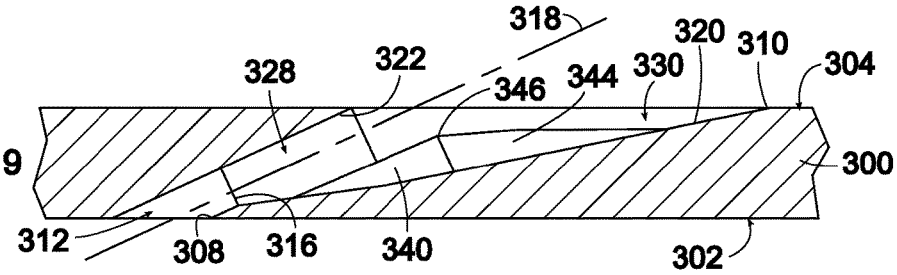
FIG. 9 is a cross-sectional view taken along lines 9-9 of FIG. 8.
Figure 10:
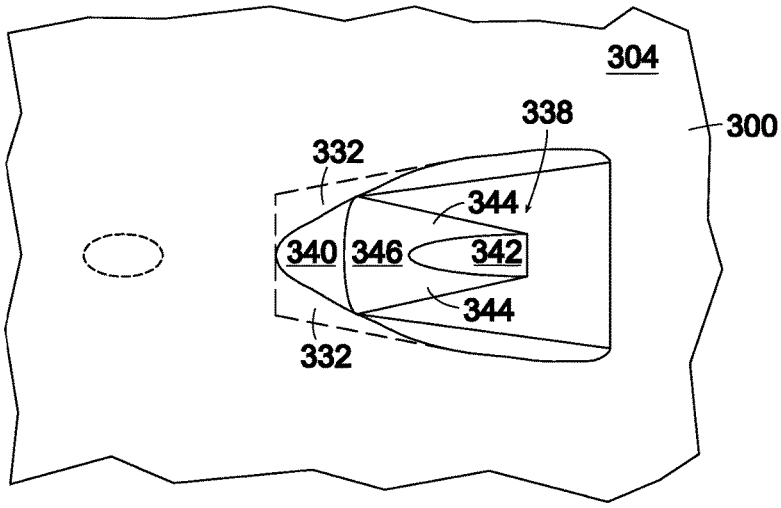
FIG. 10 is an alternative plan view of the component wall of FIG. 8.

FIGS. 8-10 illustrate a component wall 300 having another alternative diffuser hole 306 formed therein. The diffuser hole 306 is similar in construction to the diffuser hole 106 described above. Elements of the diffuser hole 306 which are not separately described may be considered to be identical to corresponding elements of the diffuser hole 106. The diffuser hole 306 extends from an inlet 308 at the inner surface 302 of the component wall 300 to an outlet 310 at the outer surface 304 of the component wall 300. The diffuser hole 306 includes a metering section 312 at its upstream end (cylindrical in this example), and a diffuser section 314 at its downstream end. The two sections 312 and 314 meet at a common junction plane 316. A hole axis 318 extends coaxially to the cylindrical metering section 312.

The metering section 312 has an area (represented by diameter "D" in the case of a cylindrical shape) which is selected, in accordance with known practices, to provide a desired mass flow rate of cooling air, given specific pressure and velocity conditions upstream and downstream of the diffuser hole 306.

The diffuser section 314 includes upstream and downstream portions 328 and 330 having different area ratios, as described above. Laterally, the diffuser section 314 is bounded by an inner wall 320, an outer wall 322, and a pair of side walls 324, 326. The four walls 320, 322, 324, and 326 merge together into one continuous peripheral wall at the junction plane 316.

The diffuser section 314 may include a pair of laterally-symmetrical wings 332 which are effectively extensions of the outer wall 322. Each wing 332 interconnects the outer wall 322 and one of the side walls 324, 326. Each wing 332 has an aft edge 334 extending at an acute angle to the hole axis 318. Collectively, the aft edges 334 of the two wings 332 form a "V"-shape with a concave curve 336 at its apex. FIG. 10 shows only the exterior visible portions of the diffuser hole 306, with the extent of the wings 332 (relative to the hooded area of a prior art diffuser hole) shown by dashed lines.

The diffuser section 314 includes a diffuser plug 338 extending radially outward from the inner wall 320, centered on the hole axis 318. The diffuser plug 338 includes an upstream face 340, a downstream face 342, and a pair of lateral faces 344 that extend axially between the upstream face 340 and the downstream face 342. The lateral faces 344 are angled towards each other and meet at a radiused peak 346. The downstream face 342 slopes aftward from the aft end of the peak 346, to the inner wall 320. The diffuser plug 338 terminates axially upstream of the aft end of the diffuser section 314.

Figure 11:
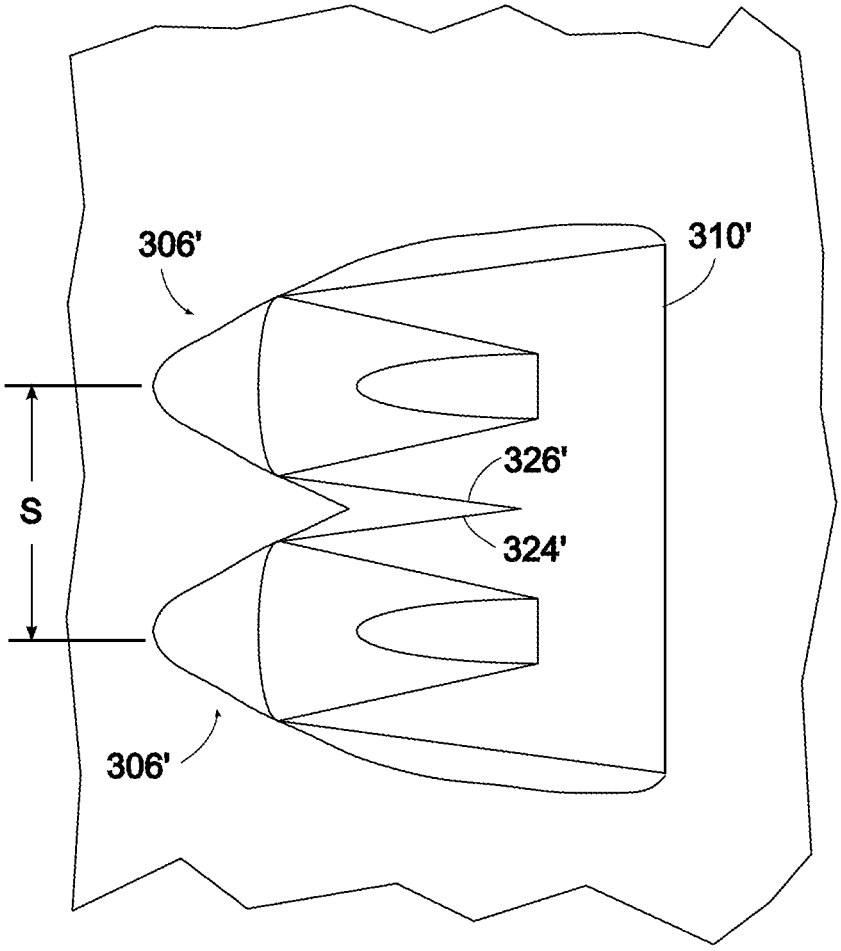
FIG. 11 is a top plan view of a portion of a component wall incorporating a pair of side-by-side merged diffuser holes.

The diffuser plug 338 functions to decrease the expansion rate of flow through the diffuser section 314 by blocking some of the flow area of the diffuser section 314. This is helpful in avoiding flow separation while still allowing a large covered area. Optionally, the diffuser holes 306 can be placed closer together so that they partially merge together. For example, FIG. 11 shows a pair of diffuser holes 306' which are generally identical to the diffuser holes 306 described above, but the lateral spacing "S" between the two is selected such that the side wall 326' of one hole 306' merges with the side wall 324' of the adjacent diffuser hole 306'. The merged side walls are displaced axially forward from the common outlet 310' of the diffuser holes 306'. This configuration increases the lateral footprint coverage of the diffuser holes 306'.

Figure 12:
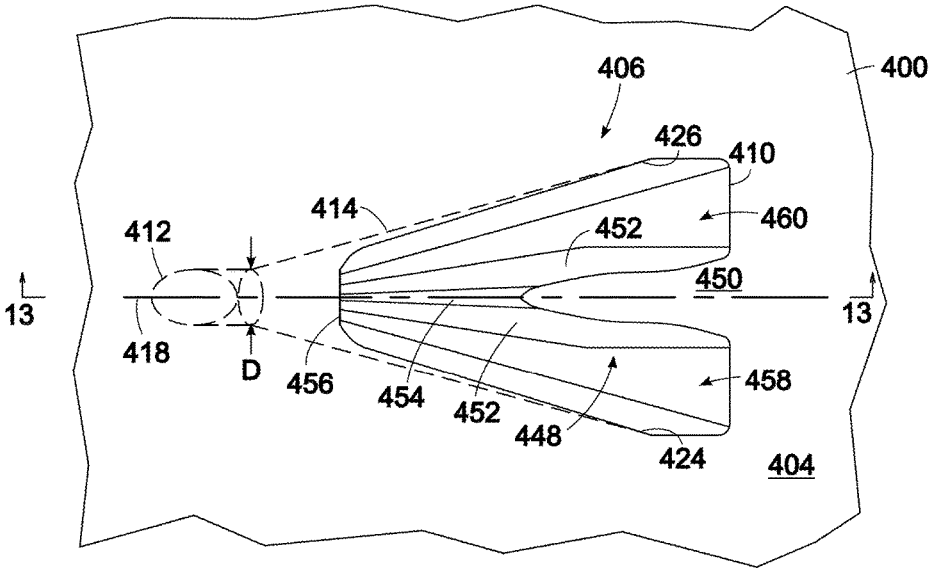
FIG. 12 is a top plan view of a portion of a component wall incorporating another alternative diffuser hole constructed in accordance with an aspect of the present invention.
Figure 13:
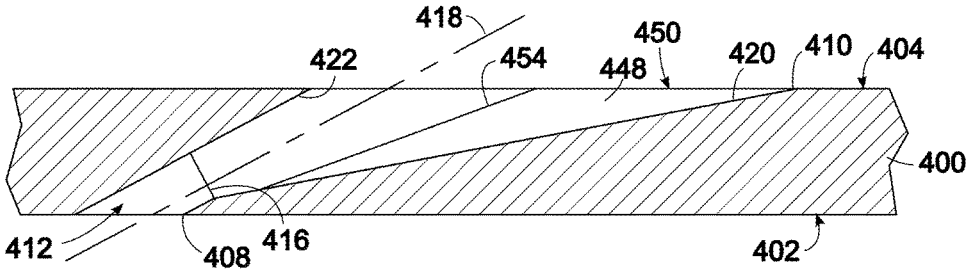
FIG. 13 is a cross-sectional view taken along lines 13-13 of FIG. 12.

FIGS. 12 and 13 illustrate a component wall 400 having another alternative diffuser hole 406 formed therein. The diffuser hole 406 is similar in construction to the diffuser hole 106 described above. Elements of the diffuser hole 406 which are not separately described may be considered to be identical to corresponding elements of the diffuser hole 106. The diffuser hole 406 extends from an inlet 408 at the inner surface 402 of the component wall 400 to an outlet 410 at the outer surface 404 of the component wall 400. The diffuser hole 406 includes a metering section 412 at its upstream end (cylindrical in this example), and a diffuser section 414 at its downstream end. The two sections 412 and 414 meet at a common junction plane 416. A hole axis 418 extends coaxially to the metering section 412.

The metering section 412 has an area (represented by diameter "D" in the case of a cylindrical shape) which is selected, in accordance with known practices, to provide a desired mass flow rate of cooling air, given specific pressure and velocity conditions upstream and downstream of the diffuser hole 406. The diffuser section 414 expands in area axially aft (that is, the area at the outlet 410 is greater than at the junction plane 416). Laterally, the diffuser section 414 is bounded by an inner wall 420, an outer wall 422, and a pair of side walls 424, 426. The four walls 420, 422, 424, and 426 merge together into one continuous peripheral wall at the junction plane 416.

The diffuser section 414 includes a diffuser pedestal 448 extending radially outward from the inner wall 420, centered on the hole axis 418. The diffuser pedestal 448 includes a generally wedge-shaped downstream face 450 which lies in plane with the outer surface 404 of the component wall 400, and a pair of lateral faces 452 that extend axially forward from the downstream face 450. The lateral faces 452 are angled towards each other and meet to form a leading edge 454 that extends from the downstream face 450 to the inner wall 420. In the illustrated example, the leading edge 454 terminates aft of the aft edge 456 of the outer wall 422.

The diffuser pedestal 448 effectively divides the aft portion of the diffuser section 414 into two separate legs 458 and 460. The diffuser pedestal 448 functions similar to the diffuser plug 338, slowing down the diffusion rate. It also functions to turn fluid flow in a more axial direction, i.e. parallel to the hole axis 418. It is possible to vary the angle of each one of legs 458, 460.

Any of the diffuser holes 106, 206, 306, 406 described above may be incorporated into a component wall in an arrangement suitable for a specific application, in accordance with known practices. For example, the diffuser holes may be used individually or arranged in one or more spanwise or oblique-extending rows on a component wall. Axially adjacent rows may be offset or interleaved with each other.

The diffuser holes described above may be formed in a component wall using various known machining processes, such as by using a laser machining process, an electrodischarge machining (EDM) process, a water jet machining process, a milling process and/or any other suitable machining process or combination of machining processes.

One known method is to provide an EDM tool (not shown) which represents the "positive" shape that forms one of the diffuser holes 106, 206, 306, 406. The EDM tool has a cylindrical portion that represents and forms the cylindrical metering section of the cooling hole, and a tapered portion that represents and forms the diffuser section.

Alternatively, the metering section of the diffuser hole may be formed in a separate manufacturing step from the diffuser portion of the diffuser hole. For example, the metering section may be initially formed within the component with the diffuser portion being subsequently machined therein or vice versa. This two-step method may be preferable where the diffuser hole does not provide a continuous line-of-sight along the hole axis, for example with the diffuser holes 306 and 406 having a plug and a pedestal, respectively. One suitable two-step process includes using an EDM tool to form the metering section, then to shape the diffuser section using a known low-power etching type of laser. This type of laser can be used to machine away material without forming a through-hole.

The diffuser holes described above have several advantages compared to prior art diffuser film cooling holes. The customized hole shape contouring results in improved effective hood length, larger footprint coverage, and better film flow attachment (i.e. reduced flow separation) from metering section to the end of the footprint. Side contouring of the diffuser holes creates better film flow vectoring relative to the gas flow. The hole shape and internal area variation suppresses flow separation due to internal shocks. The configurations that include diffuser plugs or pedestals are capable of wider diffusion angles because the internal feature reduces the flow area expansion of the hole before interaction with the gas stream.

The foregoing has described cooling hole structures for gas turbine engine components. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying potential points of novelty, abstract and drawings), or to any novel one, or any novel combination, of the steps of any method or process so disclosed.

What is claimed is:

1. A turbine component having a component wall with inner and outer surfaces wherein a diffuser hole passes through the component wall between the inner surface and the outer surface, the diffuser hole having a hole axis and comprising:

a metering section extending from an inlet at the inner surface to a junction plane between the inner and outer surfaces; and a diffuser section extending from the junction plane to an outlet at the outer surface, and increasing in flow area from the junction plane to the outlet, the diffuser section having an upstream portion defining a first area ratio and a downstream portion defining a second area ratio different from the first area ratio;

wherein the diffuser section is defined by an outer wall adjacent the outer surface, an inner wall adjacent the inner surface, and a pair of spaced-apart side walls extending between the inner and outer walls;

wherein the diffuser section includes a diffuser plug extending radially outward from the inner wall, laterally centered on the hole axis; and wherein the diffuser plug includes an upstream face, a downstream face, and a pair of lateral faces that extend axially between the upstream face and the downstream face.

2. The component of claim 1 wherein the outer wall, inner wall, and side walls merge together into one continuous peripheral wall at the junction plane.

3. The component of claim 1 wherein:

the side walls diverge away from the hole axis at a side diffusion angle, measured in a plane parallel to the outer surface of the component wall;

the inner wall diverges away from the hole axis at a layback angle measured in a plane perpendicular to the outer surface of the component wall; and the side walls define a first side diffusion angle within the upstream portion, and a second diffusion angle different from the first diffusion angle within the downstream portion.

4. The component of claim 3 wherein the inner wall defines a first layback angle within the upstream portion, and a second layback angle different from the first layback angle within the downstream portion.

5. The component of claim 1 wherein:

the side walls diverge away from the hole axis at a side diffusion angle, measured in a plane parallel to the outer surface of the component wall;

the inner wall diverges away from the hole axis at a layback angle measured in a plane perpendicular to the outer surface of the component wall; and the inner wall defines a first layback angle within the upstream portion, and a second layback angle different from the first layback angle within the downstream portion.

6. The component of claim 1 wherein the diffuser section includes a pair of laterally-symmetrical wings, each wing interconnecting the outer wall and one of the side walls.

7. The component of claim 6 in each wing has an aft edge extending at an acute angle to the hole axis.

8. The component of claim 7 wherein the aft edges of the two wings form a V-shape with a concave curve at its apex.

9. The component of claim 1 wherein the lateral faces are angled towards each other and meet at a radiused peak, and the downstream face slopes aftward from the aft end of the peak, to the inner wall.

10. The component of claim 9 wherein the diffuser plug terminates axially upstream of the outlet of the diffuser hole.

11. The component of claim 1 wherein two diffuser holes are disposed side-by-side, with a lateral spacing between the two diffuser holes selected such that a side wall of one diffuser hole merges with a side wall of the adjacent diffuser hole.

12. The component of claim 11 wherein the merged side walls are displaced axially forward from a common outlet.

* * * * *